US011629711B2

(12) United States Patent
Liu et al.

(10) Patent No.: US 11,629,711 B2
(45) Date of Patent: Apr. 18, 2023

(54) ROTOR STRUCTURE OF SCREW COMPRESSOR AND INVERTER SCREW COMPRESSOR WITH SAME

(71) Applicant: Gree Electric Appliances, Inc. of Zhuhai, Guangdong (CN)

(72) Inventors: Hua Liu, Guangdong (CN); Tianyi Zhang, Guangdong (CN); Rihua Li, Guangdong (CN); Zhongkeng Long, Guangdong (CN); Yungong Xu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 150 days.

(21) Appl. No.: 16/967,630

(22) PCT Filed: Dec. 11, 2018

(86) PCT No.: PCT/CN2018/120371
§ 371 (c)(1),
(2) Date: Aug. 5, 2020

(87) PCT Pub. No.: WO2019/153873
PCT Pub. Date: Aug. 15, 2019

(65) Prior Publication Data

US 2021/0277898 A1 Sep. 9, 2021

(30) Foreign Application Priority Data

Feb. 8, 2018 (CN) ..... 201810130545.2

(51) Int. Cl.
*F04C 18/16* (2006.01)
*F04C 18/18* (2006.01)
*F04C 18/08* (2006.01)

(52) U.S. Cl.
CPC ..... *F04C 18/16* (2013.01); *F04C 18/084* (2013.01); *F04C 2240/20* (2013.01); *F04C 2250/20* (2013.01)

(58) Field of Classification Search
CPC .... F04C 18/16; F04C 18/084; F04C 2240/20; F04C 2250/20
See application file for complete search history.

(56) References Cited

U.S. PATENT DOCUMENTS 4,412,796 A * 11/1983 Bowman ..... F01C 1/084 418/201.3
4,508,496 A 4/1985 Bowman
(Continued)

FOREIGN PATENT DOCUMENTS

CN 86108274 A * 8/1987
CN 202007780 U * 10/2011
(Continued)

OTHER PUBLICATIONS

English Derwent Abstract of CN202007780U (Year: 2011).*

*Primary Examiner* — Dominick L Plakkoottam
*Assistant Examiner* — Paul W Thiede
(74) *Attorney, Agent, or Firm* — The Webb Law Firm

(57) ABSTRACT

Provided is a rotor structure of a screw compressor and an inverter screw compressor with the same. The rotor structure includes: a female rotor including a female rotor body, wherein the female rotor body includes a plurality of female teeth, and a tooth profile is formed between tooth crests of two adjacent female teeth of the female rotor body, and the tooth profile is formed by sequentially connecting an arc segment $a_1b$ an envelope bc, an arc segment cd, an arc segment de, an arc segment $ea_2$, an arc segment $a_2a_3$ from front to rear along a counterclockwise direction, wherein
(Continued)

centers of the arc segment cd and the arc segment de are respectively located on both sides of the tooth profile.

11 Claims, 8 Drawing Sheets

(56) References Cited

U.S. PATENT DOCUMENTS

| | | | | |
|---|---|---|---|---|
| 4,643,654 | A * | 2/1987 | Rinder | F01C 1/084 418/201.3 |
| 4,938,672 | A * | 7/1990 | Ingalls | F01C 1/084 418/201.3 |
| 5,364,250 | A | 11/1994 | Aoki et al. | |
| 5,624,250 | A | 4/1997 | Son | |
| 6,296,461 | B1 * | 10/2001 | Stosic | F04C 18/084 29/888.023 |
| 2006/0039805 | A1 * | 2/2006 | Gotou | F04C 28/12 417/410.4 |

FOREIGN PATENT DOCUMENTS

| | | | |
|---|---|---|---|
| CN | 102352840 | A | 2/2012 |
| CN | 106499635 | A | 3/2017 |
| CN | 108278208 | A | 7/2018 |

* cited by examiner

ROTOR STRUCTURE OF SCREW COMPRESSOR AND INVERTER SCREW COMPRESSOR WITH SAME

CROSS-REFERENCE TO RELATED APPLICATIONS

This application is the United States national phase of International Application No. PCT/CN2018/120371 filed Dec. 11, 2018, and claims priority to Chinese Patent Application No. 201810130545.2 filed Feb. 8, 2018, the disclosures of which are hereby incorporated by reference in their entirety.

BACKGROUND OF THE INVENTION

Field of the Invention

The present disclosure relates to the technical field of a compressor device, in particular to a rotor structure of a screw compressor and an inverter screw compressor with the same.

Description of Related Art

In a related art, a constant frequency screw compressor has a limited compression performance, which causes a problem of a narrow application range for the constant frequency screw compressor. For the constant frequency screw compressor, there is already a set of optimized profile. However, in contrast with the inverter compressor, since a rotation speed of the inverter compressor is variable so that if a profile of a rotor teeth of the constant frequency screw compressor is directly used, it is likely to cause a problem of a reduced compression performance of the inverter compressor.

Furthermore, a problem of a substantial refrigerant leakage during a compression process of the compressor is caused due to the unreasonable profile configuration of the rotor structure of the constant frequency screw compressor or the inverter screw compressor in the related art.

SUMMARY OF THE INVENTION

In one aspect of the present disclosure, a rotor structure of a screw compressor is provided. The rotor structure of a screw compressor includes: a female rotor including a female rotor body, wherein the female rotor body is provided with a plurality of female teeth, and a tooth profile is formed between tooth crests of two adjacent female teeth of the female rotor body, and the tooth profile is formed by sequentially connecting an arc segment $a_1b$, an envelope bc, an arc segment cd, an arc segment de, an arc segment $ea_2$, an arc segment $a_2a_3$ from front to rear along a counterclockwise direction, wherein centers of the arc segment cd and the arc segment de are respectively located on both sides of the tooth profile.

In some embodiments, a parameter equation of the arc segment cd is:

$$\begin{cases} x_1 = R_{2t} - \Delta R - (R_3 - \Delta R)\cos t \\ y_1 = -(R_3 - \Delta R)\sin t \end{cases}, (0 \le t \le t_1);$$

wherein $R_{2t}$ is a pitch radius of the female rotor; $\Delta R$ is an adjustment parameter; a distance between a center of the arc segment cd and a tooth root of a male rotor; $R_3$ is a height of the female tooth; t is an included angle between a line connecting a point on the tooth profile with a geometric center of the female rotor body, and a line connecting the point on the tooth profile with a geometric center of the male rotor; and $t_1$ is a center angle of the arc segment cd.

In some embodiments, a parameter equation of the arc segment de is:

$$\begin{cases} x_1 = (R_8 - \Delta R)\cos t_2 - R_4\cos(t + t_2) \\ y_1 = (R_8 - \Delta R)\sin t_2 - R_4\sin(t + t_2) \end{cases}, (t_8 \le t \le t_5);$$

wherein $R_8$ is an arc center parameter of the arc segment de; $R_4$ is a radius of the arc segment de; $t_2$ is an included angle between a line connecting a rear end of the arc segment cd to the center of the arc segment cd, and a line connecting the geometric center of the female rotor body and the geometric center of the male rotor; $t_5$ is a center angle of the arc segment de; $t_8$ is a center angle of the arc segment cd.

In some embodiments, a parameter equation of the arc segment $ea_2$ is:

$$\begin{cases} x_1 = (R_{2t} - R_5)\cos t_3 + R_5\cos(t - t_2 - t_5) \\ y_1 = -(R_{2t} - R_5)\sin t_3 - R_5\sin(t - t_2 - t_5) \end{cases}, (0 \le t \le t_9),$$

wherein $R_5$ is a radius of the arc segment $ea_2$; $t_3$ is an included angle between a line connecting a rear end of the arc segment $ea_2$ and the geometric center of the female rotor body, and the line connecting the geometric center of the female rotor body and the geometric center of the male rotor; and $t_9$ is a center angle of the arc segment $ea_2$.

In some embodiments, a parameter equation of the arc segment $a_2a_3$ is:

$$\begin{cases} x_1 = R_{2t}\cos t \\ y_1 = R_{2t}\sin t \end{cases}, (t_3 \le t \le t_3 + t_0);$$

wherein $t_0$ is an included angle between a line connecting a rear end of the arc segment $a_2a_3$ and the geometric center of the female rotor body, and the line connecting the geometric center of the female rotor body and the geometric center of the male rotor angle.

In some embodiments, a parameter equation of the arc segment $a_1b$ is:

$$\begin{cases} x_1 = R_7\cos(t - t_4) + (R_{2t} - R_7)\cos t_4 \\ y_1 = -R_7\sin(t - t_4) + (R_{2t} - R_7)\sin t_4 \end{cases}, (0 \le t \le t_7);$$

wherein $R_7$ is a radius of the arc segment $a_1b$; $t_4$ is an included angle between a line connecting a front end of the arc segment $a_1b$ and the geometric center of the female rotor body, and the line connecting the geometric center of the female rotor body and the geometric center of the male rotor.

In some embodiments, a parameter equation of the envelope bc is:

$$\begin{cases} x_1 = -(R_{1t} + R_3 - R_6)\cos k\varphi_1 - R_6\cos(t - k\varphi_1) + A\cos i\varphi_1 \\ y_1 = -(R_{1t} + R_3 - R_6)\sin k\varphi_1 + R_6\sin(t - k\varphi_1) + A\sin i\varphi_1 \end{cases}$$

wherein $R_{1t}$ is a pitch radius of the male rotor; $R_6$ is a radius of an arc segment forming the envelope bc; k=i+1, i is a ratio of a number of teeth of the female rotor to a number of teeth of the male rotor; $\varphi_1$ is an angle of rotation of the male rotor; and A is a center distance between the female rotor and the male rotor.

In some embodiments, the rotor structure of a screw compressor further includes: a male rotor, wherein a male tooth of the male rotor meshes with the female tooth of the female rotor.

In some embodiments, a center of the arc segment cd of the female tooth is configured to be located on a line connecting a geometric center of the female rotor and a geometric center of the male rotor, when the female tooth meshes with the male tooth of the male rotor.

In some embodiments, an area utilization coefficient of the male rotor and the female rotor is Q, wherein $0.429 \leq Q$.

According to another aspect of the present disclosure, there is provided an inverter screw compressor including the rotor structure of a screw compressor described above.

By applying the technical solution of the present disclosure, the tooth profile is formed between tooth crests of two adjacent female teeth on an end surface of the female rotor body, and the tooth profile is formed by sequentially connecting an arc segment $a_1b$, an envelope bc, an arc segment cd, an arc segment de, an arc segment $ea_2$, an arc segment $a_2a_3$ in an end-to-end fashion along a counterclockwise direction, wherein centers of the arc segment cd and the arc segment de are located on both sides of the tooth profile. Such arrangement is adapt to effectively optimize the tooth profile, so that the opening of the tooth profile is larger than that of the tooth profile of the rotor structure in the related art, then a variation of pressure difference between an internal environment and an external environment of the rotor structure is reduced, thereby a leakage of refrigerant from inside the rotor structure is reduced. The rotor structure is adopted to make a configuration of the tooth profile more reasonable and reduce a rotation speed of the rotor structure at the same flow rate. In particular, an inverter screw compressor with the rotor structure is adapted to make a profile of the rotor structure suitable for the inverter screw compressor, then a leakage of the compressor is effectively reduced, thereby a compression energy efficiency and application of the inverter screw compressor is improved.

BRIEF DESCRIPTION OF THE DRAWINGS

The accompanying drawings of the description forming part of the present disclosure are used to provide a further understanding of the present disclosure. The schematic embodiments of the present disclosure as well as the descriptions thereof which are used to explain the present disclosure, do not constitute an inappropriate limitation on the present disclosure. In the accompanying drawings.

Figure 1:
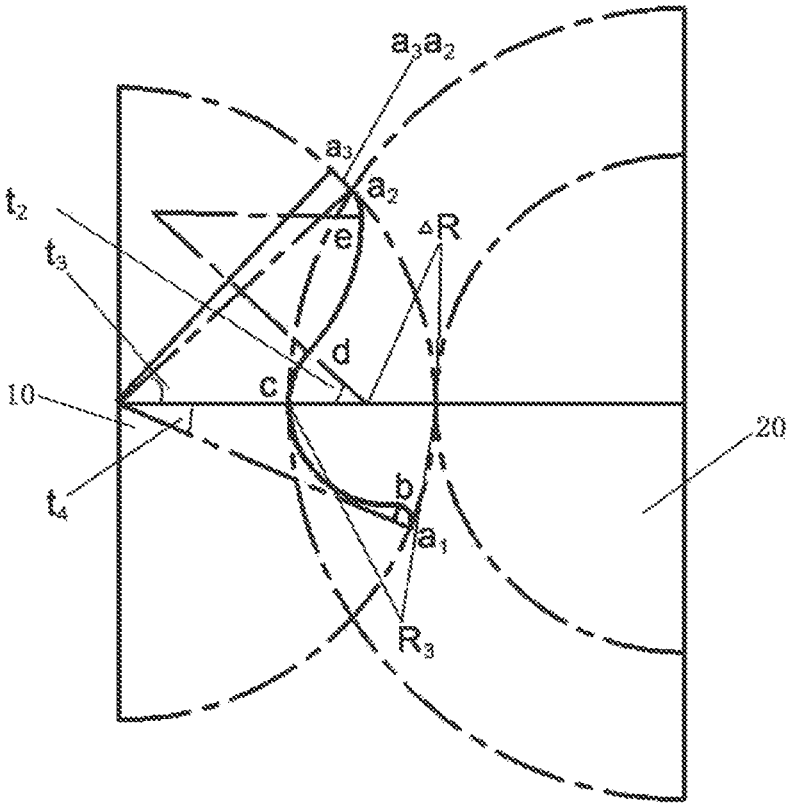
FIG. 1 shows a schematic structural view of Embodiment 1 of a tooth profile of the rotor structure according to the present disclosure.

Wherein, the above-described accompanying drawings include the following reference signs:

10. female rotor body; 11. female tooth; 20. male rotor; 21. male tooth.

DESCRIPTION OF THE INVENTION

It should be noted that the embodiments in the present disclosure and the features in the embodiments may be combined with each other in the case where there is no conflict. The present disclosure will be described in detail below with reference to the accompanying drawings and in conjunction with the embodiments.

It should be noted that the terms used here are only for describing specific embodiments, not intended to limit exemplary embodiments according to the present disclosure. As used here, unless explicitly indicated otherwise in the context, the singular form is also intended to include the plural form. In addition, it should also be understood that when the terms "comprising" and/or "including" are used in the present specification, it is indicated that there are features, steps, operations, devices, assemblies, and/or combinations thereof.

It should be noted that the terms "first", "second" and the like in the specification, claims and accompanying drawings of the present disclosure are used to distinguish similar objects, but not necessarily used to describe a specific order or sequence. It should be understood that the terms thus used may be interchanged under appropriate circumstances, so that the embodiments of the present disclosure described here can be, for example, implemented in an order other than those illustrated or described here, for example. In addition, the terms "including", "having" and any variations thereof are intended to cover non-exclusive inclusions. For example, processes, methods, systems, products or devices that contain a series of steps or units are not necessarily limited to those steps or units explicitly listed, but may include other steps or units that are not explicitly listed or that are inherent to these processes, methods, products, or devices.

For ease of description, spatial relative terms such as "on", "above", "on an upper surface of" and "upper", which may be used here, are used to describe the spatial relationship between a device or feature shown and other devices or features. It should be understood that the spatially relative terms are intended to encompass different orientations during use or operation in addition to the orientation of the device described in the drawings. For example, if the device in the accompanying drawings is turned upside down, the device described as "above another device or configuration" or "above another device or configuration" will then be positioned to be "below another device or configuration" or "below another device or structure" thereinafter. Thus, the exemplary term "above" may include such two orientations as "above" and "below". The device may also be positioned in other different ways (rotated 90 degrees or at other orientations), and the relative description of the space used here is explained accordingly.

Now, exemplary embodiments according to the present disclosure will be described in more detail with reference to the accompanying drawings. However, these exemplary embodiments may be implemented in a plurality of different forms and should not be construed as being limited to the embodiments set forth here. It should be understood that these embodiments are provided to make the disclosure of the present disclosure thorough and complete, and to adequately convey the idea of these exemplary embodiments to those of ordinary skill in the art. In the accompanying drawings, for the sake of clarity, it is possible to expand the thicknesses of the layers and areas, and the same reference signs are used to present the same devices, and thus their description will be omitted.

According to the embodiments of the present disclosure, a rotor structure of a screw compressor and an inverter screw compressor with the same are provided, which are adapted to alleviate the problem of substantial leakage of the screw compressor in the related art.

In some embodiments, as shown in FIGS. 1 to 8, the rotor structure of a screw compressor includes: a female rotor including a female rotor body 10. The female rotor body 10 is provided with a plurality of female teeth 11, and a tooth profile is formed between tooth crests of two adjacent female teeth 11 of the female rotor body 10, and the tooth profile is formed by sequentially connecting an arc segment $a_1b$, an envelope bc, an arc segment cd, an arc segment de, an arc segment $ea_2$, an arc segment $a_2a_3$ from front to rear along a counterclockwise direction, wherein centers of the arc segment cd and the arc segment de are respectively located on both sides of the tooth profile.

In some present embodiments, such arrangement is adapt to effectively optimize the tooth profile, so that the opening of the tooth profile is larger than that of the tooth profile of the rotor structure in the related art, then a variation of pressure difference between the internal environment and the external environment of the rotor structure is reduced, thereby the leakage of refrigerant from inside the rotor structure is reduced. The rotor structure is adopted to make the configuration of the tooth profile more reasonable and reduce a rotation speed of the rotor structure at the same flow rate. In particular, the inverter screw compressor with the rotor structure is adapted to make the profile of the rotor structure suitable for the inverter screw compressor, then the leakage of the compressor is effectively reduced, thereby improving the compression energy efficiency and application of the inverter screw compressor is improved.

In some present embodiments, the rotor structure includes a female rotor and a male rotor. With the profile characteristics of the female rotor provided in the present disclosure, the profile characteristics of the male rotor are tended to be exclusively obtained according to the female rotor. The profile design of the rotor is generally such that the profile of the female rotor or the male rotor is first provided, and then the profile of another rotor is obtained according to the envelope principle of the profile.

As shown in FIG. 1, a geometric center of the female rotor body 10 is taken as an origin, a straight line connecting the geometric center of the female rotor body 10 and a geometric center of the male rotor is taken as an abscissa axis, and another straight line perpendicular to the straight line connecting the geometric center of the female rotor body 10 and the geometric center of the male rotor is taken as an ordinate axis, a rectangular coordinate system is established, wherein a parameter equation of the arc segment cd is:

$$\begin{cases} x_1 = R_{2t} - \Delta R - (R_3 - \Delta R)\cos t \\ y_1 = -(R_3 - \Delta R)\sin t \end{cases}, (0 \le t \le t_1);$$

wherein $R_{2t}$ is a pitch radius of the female rotor; $\Delta R$ is an adjustment parameter; a distance between a center of the arc segment cd and a tooth root of a male rotor; $R_3$ is a height of the female tooth 11; t is an included angle between a line connecting a point on the tooth profile with a geometric center of the female rotor body 10, and a line connecting the point on the tooth profile with the geometric center of the male rotor; and $t_1$ is a center angle of the arc segment cd.

In some embodiments, a parameter equation of the arc segment de is:

$$\begin{cases} x_1 = (R_8 - \Delta R)\cos t_2 - R_4\cos(t + t_2) \\ y_1 = (R_8 - \Delta R)\sin t_2 - R_4\sin(t + t_2) \end{cases}, (t_8 \le t \le t_5);$$

wherein $R_8$ is an arc center parameter of the arc segment de; $R_4$ is a radius of the arc segment de; $t_2$ is an included angle between a line connecting a rear end of the arc segment cd to the center of the arc segment cd, and a line connecting the geometric center of the female rotor body 10 and the geometric center of the male rotor; $t_5$ is a center angle of the arc segment de; $t_8$ is a center angle of the arc segment cd.

In some embodiments, a parameter equation of the arc segment $ea_2$ is:

$$\begin{cases} x_1 = (R_{2t} - \Delta R)\cos t_3 + R_5\cos(t - t_2 - t_5) \\ y_1 = -(R_{2t} - R_5)\sin t_2 - R_5\sin(t - t_2 - t_5) \end{cases}, (0 \le t \le t_9),$$

wherein $R_5$ is a radius of the arc segment $ea_2$; $t_3$ is an included angle between a line connecting a rear end of the arc segment $ea_2$ and the geometric center of the female rotor body 10, and the line connecting a geometric center of the female rotor body 10 and the geometric center of the male rotor; and $t_9$ is a center angle of the arc segment $ea_2$.

In some embodiments, a parameter equation of the arc segment $a_2a_3$ is:

$$\begin{cases} x_1 = R_{2t}\cos t \\ y_1 = R_{2t}\sin t \end{cases}, (t_3 \le t \le t_3 + t_0);$$

wherein $t_0$ (e.g., $t_0$ is the angular measurement between the line $a_3O_2$ and line $a_2O_2$) is an included angle between a line connecting a rear end of the arc segment $a_2a_3$ and the geometric center of the female rotor body 10, and the line connecting the geometric center of the female rotor body 10 and the geometric center of the male rotor angle.

In some embodiments, a parameter equation of the arc segment $a_1b$ is:

$$\begin{cases} x_1 = R_7\cos(t - t_4) + (R_{2t} - R_7)\cos t_4 \\ y_1 = -R_7\sin(t - t_4) + (R_{2t} - R_7)\sin t_4 \end{cases}, (0 \le t \le t_7);$$

wherein $R_7$ is a radius of the arc segment $a_1b$; $t_4$ is an included angle between a line connecting a front end of the arc segment $a_1b$ and the geometric center of the female rotor body 10, and the line connecting a geometric center of the female rotor body 10 and the geometric center of the male rotor.

In some embodiments, a parameter equation of the envelope bc is:

$$\begin{cases} x_1 = -(R_{1t} + R_3 - R_6)\cos k\varphi_1 - R_6\cos(t - k\varphi_1) + A\cos i\varphi_1 \\ y_1 = -(R_{1t} + R_3 - R_6)\sin k\varphi_1 + R_6\sin(t - k\varphi_1) + A\sin i\varphi_1 \end{cases}$$

wherein $R_{1t}$ is a pitch radius of the male rotor; $R_6$ is a radius of an arc segment forming the envelope bc; k=i+1, i is a ratio of a number of teeth of the female rotor to a number of teeth of the male rotor; $\varphi_1$ is an angle of rotation of the male rotor; and A is a center distance between the female rotor and the male rotor. The female rotor and the male rotor of the rotor structure mesh with each other to realize a compression operation.

Specifically, when the female tooth 11 meshes with the male tooth of the male rotor, a center of the arc segment cd of the female tooth 11 is located on a line connecting a geometric center of the female rotor and a geometric center of the male rotor. A distance between a center of the are segment cd and a line connecting the geometric center of the female rotor body 10 and the geometric center of the male rotor is less than a distance between a center of the arc segment de and the line connecting the geometric center of the female rotor body 10 and the geometric center of the male rotor. Wherein, the projection of the arc segment cd is not intersect with that of the arc segment de on the ordinate axis.

Since the rotor structure adopts the structure, an area utilization coefficient of the male rotor and the female rotor is Q, wherein 0.429≤Q.

Figure 2:
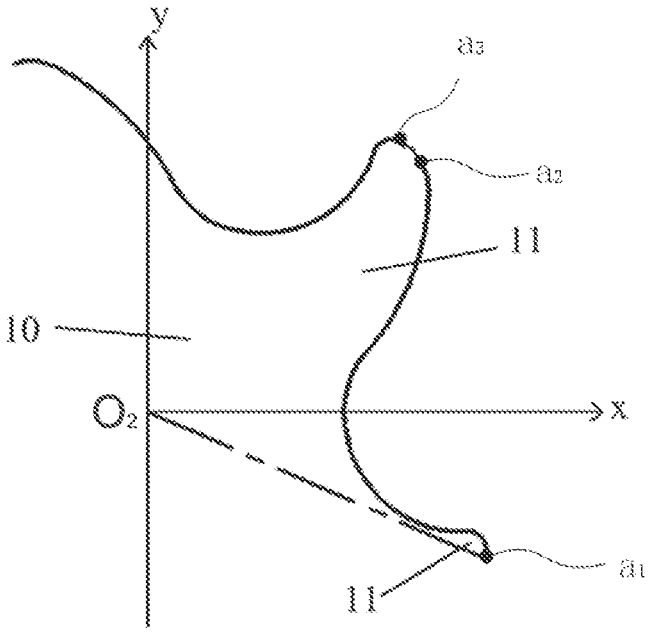
FIG. 2 shows a structural schematic view of Embodiment 2 of a tooth profile of the rotor structure according to the present disclosure.

As shown in FIG. 2, in some present embodiments, the female rotor is provided with six female teeth e.g., the female rotor has six tooth profiles, and each curve has the same parameter equation. That is, a point $a_3$ on a starting end of a second profile line in the clockwise direction in FIG. 2 corresponds to a point $a_1$ on a starting end of a first profile line below it, and the connections of the respective arc segments are in smooth transition.

By adopting the rotor structure, it is adapted to effectively improve an area utilization coefficient of the male rotor and the female rotor, thereby a practicality and reliability of the rotor structure is effectively improved.

The rotor structure of a screw compressor in the above embodiments is also adapted to the technical field of an inverter compression device. That is, according to another aspect of the present disclosure, an inverter screw compressor is provided. The inverter screw compressor includes the rotor structure of a screw compressor described above.

The rotor compressor with the rotor structure has the following technical effects:

| | Area of male rotor/mm$^2$ | Area of female rotor/mm$^2$ | Utilization coefficient of area | Area of vent hole/m$^2$ |
|---|---|---|---|---|
| Related art | 1562.33 | 1450.88 | 0.429 | 0.0025 |
| Present disclosure | 1672.75 | 1594.94 | 0.4874 | 0.0027 |

Under the same size of the rotor, since the profile has a large area utilization coefficient, it has a large theoretical volume of displacement for each revolution. Therefore, in order to achieve the same displacement, the rotor speed of the tooth profile in the present disclosure is reduced. The reduction in the rotation speed is adapted to reduce the frictional loss between rotors and the oil loss in suction and displacement, thereby the energy efficiency is improved.

In another aspect, at a high rotation speed in a variable frequency, the compressor has a relatively large displacement flow. At this time, the size of the vent hole has a great influence on the pressure loss in displacement (for the constant frequency screw compressor, due to a smaller flow of displacement, the pressure loss caused by the size of the vent hole is not a main factor affecting the energy efficiency). The rotor structure with the tooth profile is adopted to allow a larger area of the vent hole of the rotor structure, so as to reduce the pressure loss in displacement of the compressor, thereby the energy efficiency of the compressor is improved.

Figure 3:
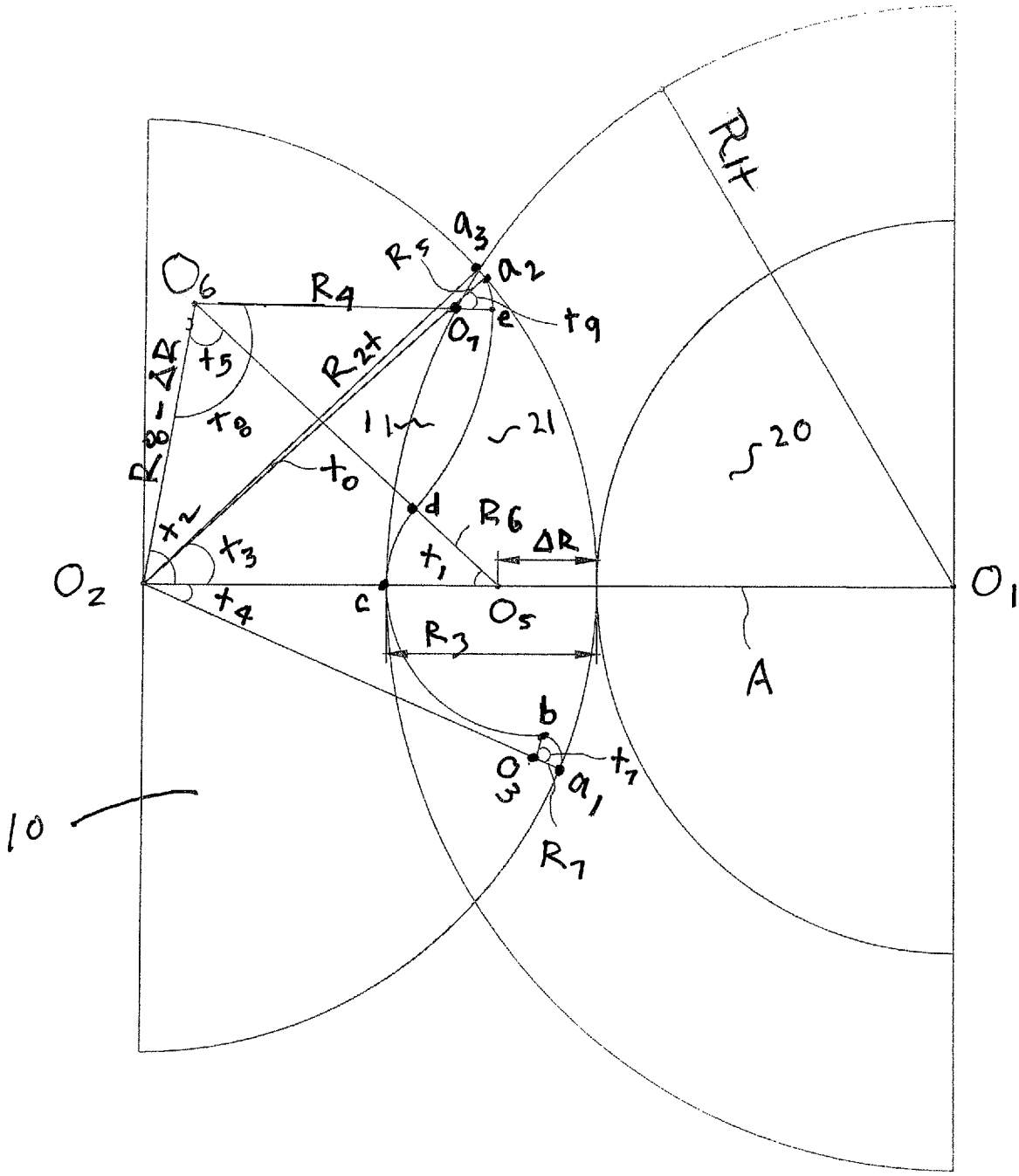
FIG. 3 is a structure diagram of a tooth profile of the rotor structure provided according to some embodiments of the present disclosure.
Figure 4:
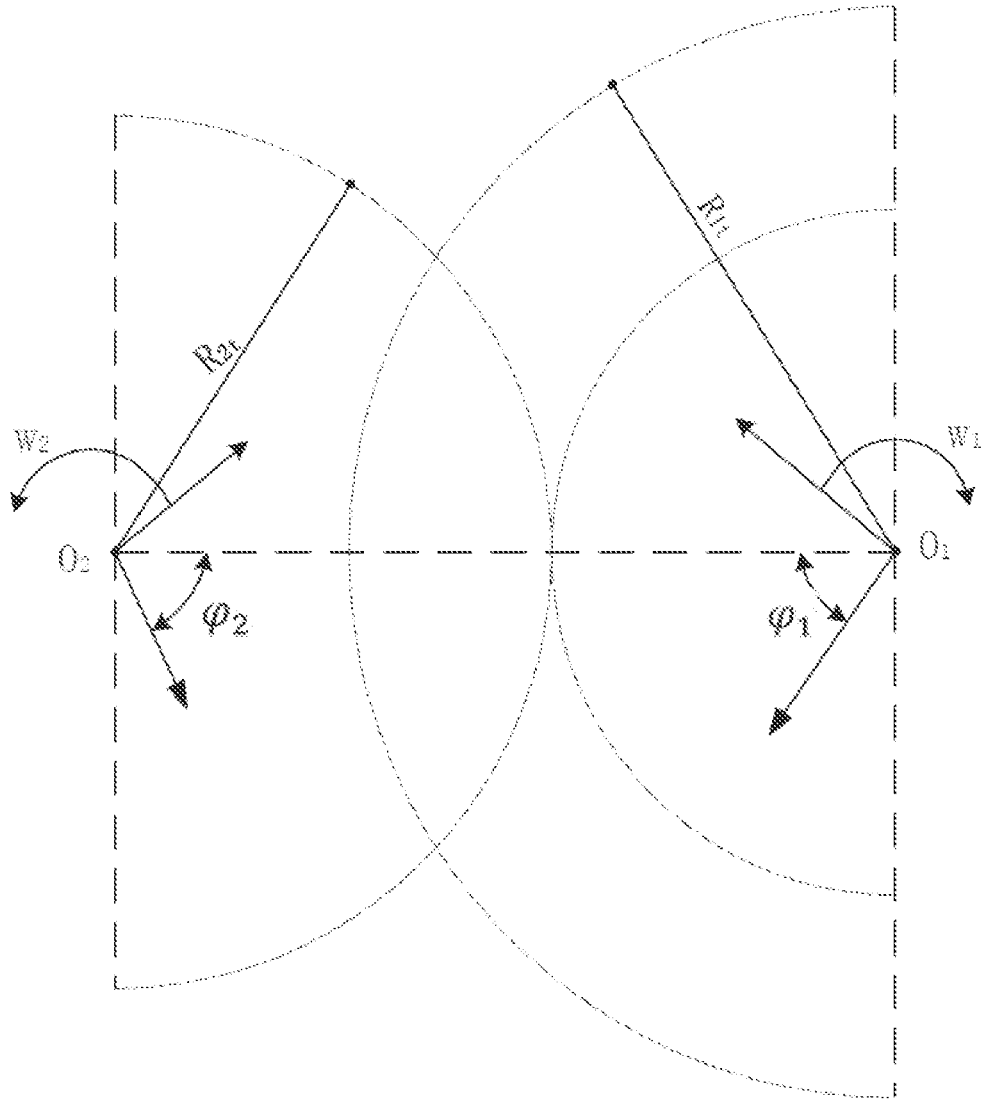
FIG. 4 is a schematic diagram of the rotation angles of the female rotor and the male rotor provided by some embodiments of the present disclosure.
Figure 5:
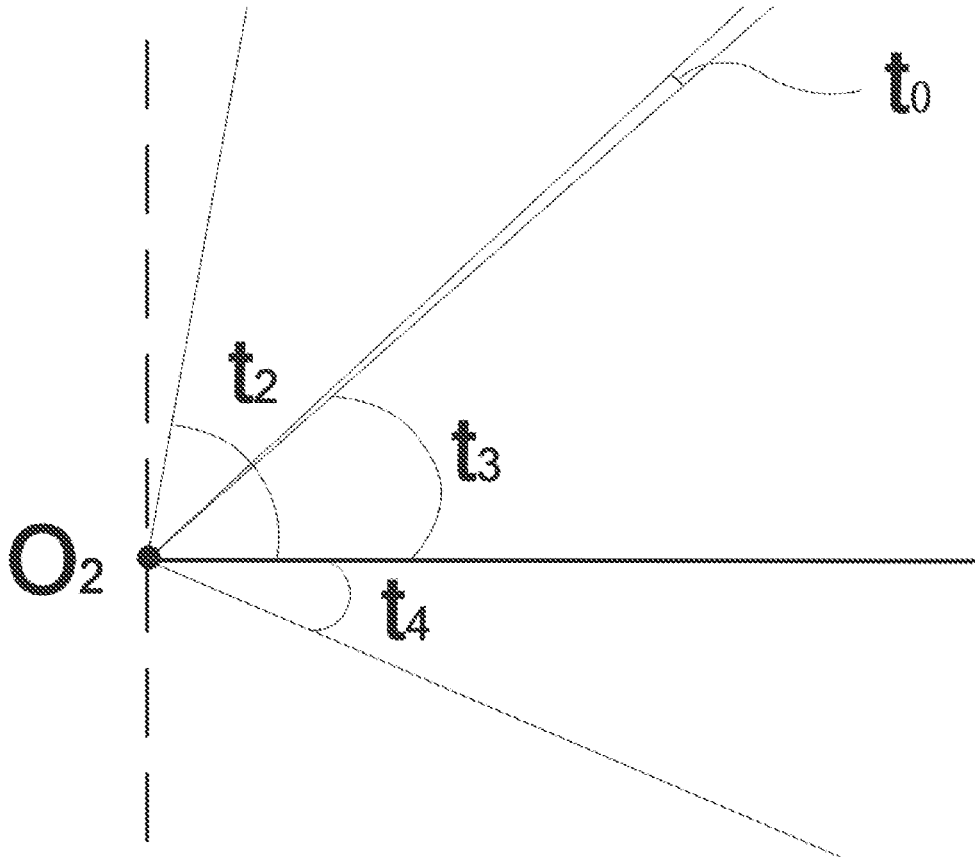
FIG. 5 is a first partial enlarged schematic diagram of FIG. 3.
Figure 6:
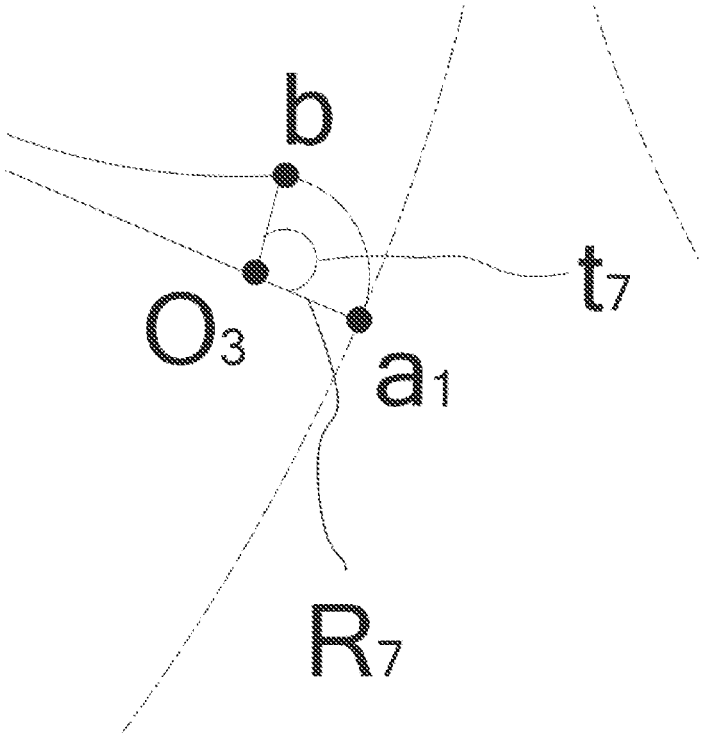
FIG. 6 is a second partial enlarged schematic diagram of FIG. 3.
Figure 7:
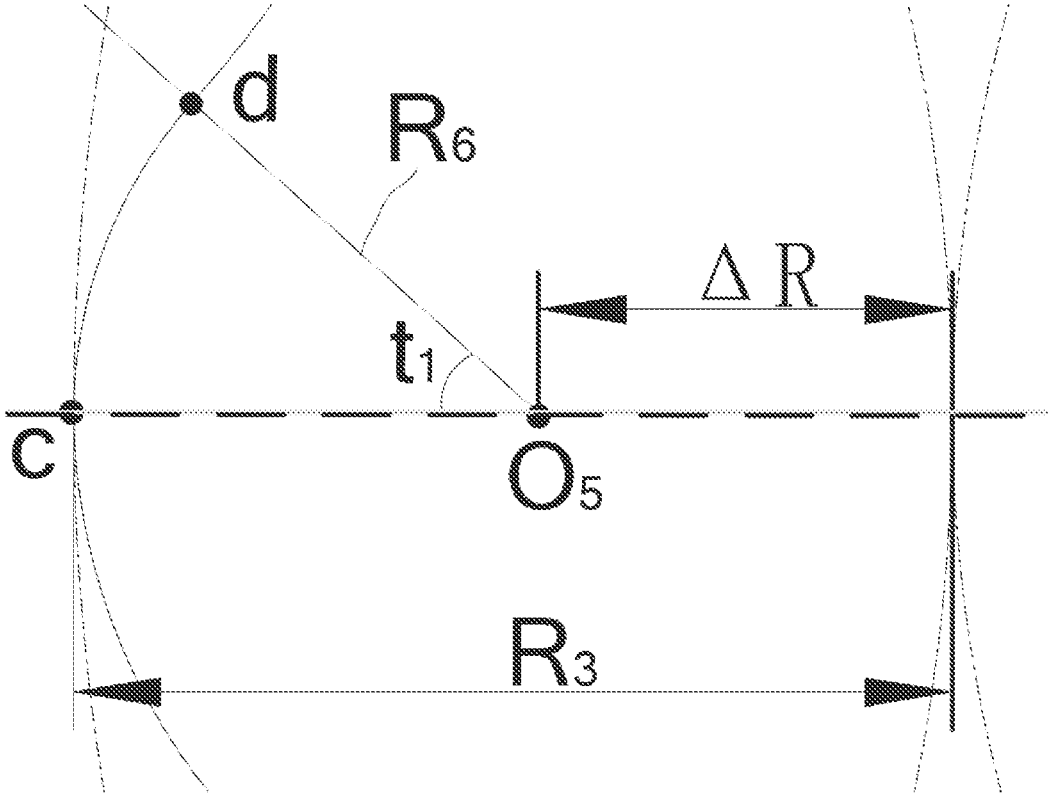
FIG. 7 is a third partial enlarged schematic diagram of FIG. 3.
Figure 8:
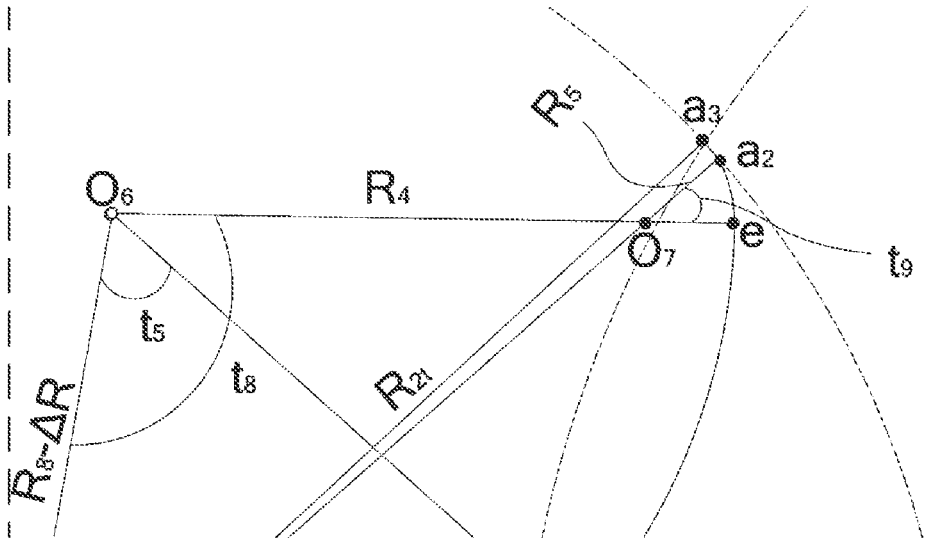
FIG. 8 is a fourth partial enlarged schematic diagram of FIG. 3.

As shown in FIG. 3, and FIGS. 5-8 illustrating enlarged schematic diagrams of portions of FIG. 3, $O_2$ may represent the geometric center of the female rotor body 10 and $O_1$ may represent the geometric center of the male rotor body 20. Further, an arc center $O_3$ is the center of the arc segment $a_1b$, an arc center $O_5$ is the center of the arc segment cd, an arc center $O_6$ is the center of the arc segment de, and an arc center $O_7$ is the center of the arc segment $ea_2$.

In some non-limiting embodiments or aspects, $R_{2t}$ is a pitch radius of the female rotor body 10. Further, ΔR is an adjustment parameter, and indicates a distance between the arc center $O_5$ of the arc segment cd and a tooth root of the male rotor body 20. $R_3$ is a height of the female tooth 11.

Further, $t_0$ is an included angle between a line connecting a rear end of the arc segment $a_2a_3$ and the geometric center $O_2$ of the female rotor body 10, and the line connecting the geometric center $O_2$ of the female rotor body 10 and a rear end of the arc segment $ea_2$. and is a center angle of the arc segment cd. Further, $t_2$ is an included angle between a line connecting the arc center $O_2$ to the arc center $O_6$ and a line connecting the geometric center $O_2$ of the female rotor body 10 and the geometric center $O_1$ of the male rotor body 20.

As further shown in FIG. 3, $t_3$ is an included angle between a line connecting a rear end of the arc segment $ea_2$ and the geometric center $O_2$ of the female rotor body 10, and the line connecting the geometric center $O_2$ of the female rotor body 10 and the geometric center $O_1$ of the male rotor body 20. $t_4$ is an included angle between a line connecting a front end of the arc segment $a_1b$ and the geometric center $O_2$ of the female rotor body 10, and the line connecting the geometric center $O_2$ of the female rotor body 10 and the geometric center $O_1$ of the male rotor body 20. $t_5$ is an included angle between a line connecting the arc center $O_6$ to the arc center $O_2$ and a line connecting the arc center $O_6$ to the arc center $O_5$. As further shown, $t_8$ is an included angle between a line connecting the arc center $O_2$ to the arc center $O_6$ and a line connecting the arc center $O_6$ to a front end of the arc segment $ea_2$. $R_5$ represents a radius of the arc segment $ea_2$. In addition, $t_9$ is a center angle of the arc segment $ea_2$, and $t_7$ is a center angle of the arc segment $a_1b$.

As further shown in FIG. 3, arc center $O_5$ of the arc segment cd of the female tooth is configured to be located on a line connecting a geometric center $O_2$ of the female rotor and a geometric center $O_1$ of the male rotor, when the female tooth meshes with the male tooth of the male rotor. In some non-limiting embodiments or aspects, $R_4$ is a radius of the arc segment de, $R_6$ is a radius of an arc segment forming the envelope bc. In some examples, $R_7$ is a radius of the arc segment $a_1b$. In some examples, $R_8$ is a parameter of the arc segment de.

In addition to the above-described, it is also necessary to explain that "one embodiment", "another embodiment", "embodiment" and the like, mentioned in the present specification, mean that the specific features, structures or features described in conjunction with this embodiment are included in at least one embodiment generally described in the present disclosure. The same expression recited in multiple places of the specification does not necessarily refer to the same embodiment. Further, when a specific feature, structure, or characteristic is described in conjunction with any of the embodiments, it is claimed that such feature, structure, or characteristic in combination with other embodiments also falls within the scope of the present disclosure.

In the above-described embodiments, the description of the respective embodiments has own emphasis. For a portion that is not detailed in detail in an embodiment, reference may be made to related descriptions in other embodiments.

The above descriptions which are only the preferred embodiments of the present disclosure, are not intended to limit the present disclosure. For those skilled in the art, the present disclosure may have various modifications and changes. Any modification, equivalent replacement, improvement and the like made within the spirit and principle of the present disclosure shall be included in the protection scope of the present disclosure.

The invention claimed is:

1. A rotor structure of a screw compressor, comprising:

a female rotor comprising a female rotor body, wherein the female rotor body is provided with a plurality of female teeth, and a tooth profile $a_1a_3$ is formed between tooth crests of two adjacent female teeth of the female rotor body, and the tooth profile $a_1$ $a_3$ is formed by sequentially connecting an arc segment $a_1b$, an envelope bc, an arc segment cd, an arc segment de, an arc segment $ea_2$, an arc segment $a_2a_3$ from front to rear along a counterclockwise direction, an arc center $O_5$ of the arc segment cd is located on one side of the tooth profile $a_1a_3$ on the side of a male rotor, an arc center $O_3$ of the arc segment $a_1b$, an arc center $O_6$ of the arc segment de, and an arc center $O_7$ of the arc segment $ea_2$ are located on another side of the tooth profile $a_1a_3$ on the side of the female rotor;

a radius $R_4$ of the arc segment de is more than a radius $(R_3-\Delta R)$ of the arc segment cd.

2. The rotor structure of a screw compressor according to claim 1, wherein a parameter equation of the arc segment cd is:

$$\begin{cases} x_1 = R_{2t} - \Delta R - (R_3 - \Delta R)\cos t \\ y_1 = -(R_3 - \Delta R)\sin t \end{cases}, (0 \le t \le t_1);$$

wherein $R_{2t}$ is a pitch radius of the female rotor;

$\Delta R$ is an adjustment parameter, and indicates a distance between the arc center $O_5$ of the arc segment cd and a tooth root of the male rotor;

$R_3$ is a height of the female tooth;

t is an included angle between a line connecting a point on the tooth profile $a_1$ $a_3$ with the geometric center $O_2$ of the female rotor body, and a line connecting the point on the tooth profile $a_1$ $a_3$ with the geometric center $O_1$ of the male rotor; and $t_1$ is a center angle of the arc segment cd.

3. The rotor structure of a screw compressor according to claim 2, wherein a parameter equation of the arc segment de is:

$$\begin{cases} x_1 = (R_8 - \Delta R)\cos t_2 - R_4\cos(t + t_2) \\ y_1 = (R_8 - \Delta R)\sin t_2 - R_4\sin(t + t_2) \end{cases}, (t_8 \le t \le t_5);$$

wherein $R_8$ is an arc center parameter of the arc segment de;

$R_4$ is the radius of the arc segment de;

$t_2$ is an included angle between a line connecting the arc center $O_2$ to the arc center $O_6$ and a line connecting the geometric center $O_2$ of the female rotor body and the geometric center $O_1$ of the male rotor;

$t_5$ is an included angle between a line connecting the arc center $O_6$ to the arc center $O_2$ and a line connecting the arc center $O_6$ to the arc center $O_5$; and $t_8$ is an included angle between a line connecting the arc center $O_6$ to the arc center $O_2$ and a line connecting the arc center $O_6$ to the front end of the arc segment $ea_2$.

4. The rotor structure of a screw compressor according to claim 3, wherein a parameter equation of the arc segment $ea_2$ is:

$$\begin{cases} x_1 = (R_{2t} - \Delta R)\cos t_3 + R_5\cos(t - t_2 - t_5) \\ y_1 = -(R_{2t} - R_5)\sin t_2 - R_5\sin(t - t_2 - t_5) \end{cases}, (0 \le t \le t_9),$$

wherein $R_5$ is a radius of the arc segment $ea_2$;

$t_3$ is an included angle between a line connecting a rear end of the arc segment $ea_2$ and the geometric center $O_2$ of the female rotor body, and the line connecting the geometric center $O_2$ of the female rotor body and the geometric center $O_1$ of the male rotor; and $t_9$ is a center angle of the arc segment $ea_2$.

5. The rotor structure of a screw compressor according to claim 4, wherein a parameter equation of the arc segment $a_2a_3$ is:

$$\begin{cases} x_1 = R_{2t}\cos t \\ y_1 = R_{2t}\sin t \end{cases}, (t_3 \le t \le t_3 + t_0);$$

wherein $t_0$ is an included angle between a line connecting a rear end of the arc segment $a_2a_3$ and the geometric center $O_2$ of the female rotor body, and the line connecting the geometric center $O_2$ of the female rotor body and the rear end of the arc segment $ea_2$.

6. The rotor structure of a screw compressor according to claim 5, wherein a parameter equation of the arc segment $a_1b$ is:

$$\begin{cases} x_1 = R_7\cos(t - t_4) + (R_{2t} - R_7)\cos t_4 \\ y_1 = -R_7\sin(t - t_4) + (R_{2t} - R_7)\sin t_4 \end{cases}, (0 \le t \le t_7);$$

wherein $R_7$ is a radius of the arc segment $a_1b$;

$t_4$ is an included angle between a line connecting a front end of the arc segment $a_1b$ and the geometric center $O_2$ of the female rotor body, and the line connecting the geometric center $O_2$ of the female rotor body and the geometric center $O_1$ of the male rotor.

7. The rotor structure of a screw compressor according to claim 6, wherein a parameter equation of the envelope be is:

$$\begin{cases} x_1 = -(R_{1t} + R_3 - R_6)\cos k\varphi_1 - R_6\cos(t - k\varphi_1) + A\cos i\varphi_1 \\ y_1 = -(R_{1t} + R_3 - R_6)\sin k\varphi_1 + R_6\sin(t - k\varphi_1) + A\sin i\varphi_1 \end{cases}$$

wherein $R_{1t}$ is a pitch radius of the male rotor;

$R_6$ is a radius of an arc segment forming the envelope bc;

k=i+1, i is a ratio of a number of teeth of the female rotor to a number of teeth of the male rotor;

$\varphi_1$ is an angle of rotation of the male rotor; and

A is a center distance between the geometric center $O_2$ of the female rotor and the geometric center $O_1$ of the male rotor.

8. The rotor structure of a screw compressor according to claim 1, further comprising:

a male rotor, wherein a male tooth of the male rotor meshes with the female tooth of the female rotor.

9. The rotor structure of a screw compressor according to claim 8, wherein the arc center $O_5$ of the arc segment cd of the female tooth is configured to be located on a line connecting a geometric center $O_2$ of the female rotor and a geometric center $O_1$ of the male rotor, when the female tooth meshes with the male tooth of the male rotor.

10. The rotor structure of a screw compressor according to claim 8, wherein an area utilization coefficient of the male rotor and the female rotor is Q, wherein $0.429 \leq Q$.

11. An inverter screw compressor comprising the rotor structure of a screw compressor according to claim 1.

* * * * *